US006925912B2

(12) United States Patent
Huang

(10) Patent No.: US 6,925,912 B2
(45) Date of Patent: Aug. 9, 2005

(54) OPERATING DEVICE FOR A SCREWDRIVER

(76) Inventor: Chin-Tan Huang, No. 39, Lane 240, Liren Rd., Dali City, Taichung County (TW)

( * ) Notice: Subject to any disclaimer, the term of this patent is extended or adjusted under 35 U.S.C. 154(b) by 0 days.

(21) Appl. No.: 10/661,625

(22) Filed: Sep. 15, 2003

(65) Prior Publication Data

US 2004/0055424 A1 Mar. 25, 2004

Related U.S. Application Data

(63) Continuation-in-part of application No. 10/226,270, filed on Aug. 23, 2002, now Pat. No. 6,644,147.

(51) Int. Cl.[7] ..... B25B 13/46

(52) U.S. Cl. ..... 81/62; 81/63.1; 81/58.4; 192/43.2

(58) Field of Search ..... 81/61–63.2, 59.1, 81/58.4, 58; 192/43.2, 44, 45

(56) References Cited

U.S. PATENT DOCUMENTS 5,974,915 A * 11/1999 Chou ..... 81/63.1
6,250,183 B1 * 6/2001 Chiang ..... 81/63.2
6,349,619 B1 * 2/2002 Liao ..... 81/62
6,658,970 B2 * 12/2003 Shiao ..... 81/62

* cited by examiner

*Primary Examiner*—Hadi Shakeri
(74) *Attorney, Agent, or Firm*—Rosenberg, Klein & Lee

(57) ABSTRACT

A operating device for a screwdriver includes a body partially secured in a handle of the screwdriver, a barrel partially and pivotally received in the body and a controller pivotally mounted on the body for controlling an operated direction of the operating device.

9 Claims, 6 Drawing Sheets

OPERATING DEVICE FOR A SCREWDRIVER

CROSS-REFERENCE TO RELATED APPLICATION

This application is a Continuation-In-Part application of Ser. No. 10/226,270, filed Aug. 23, 2002, and entitled "OPERATING DEVICE FOR A SCREWDRIVER", now U.S. Pat. No. 6,644,147.

BACKGROUND OF THE INVENTION

1. Field of the Invention

The present invention relates to an operating device, and more particularly to an operating device for a screwdriver.

2. Description of Related Art

A conventional operating device for a screwdriver in accordance with the prior art shown in FIG. 7 comprises a pivot seat (50) having two channels (51) defined and extending into the pivot seat (50) from the outer periphery of the pivot seat (50). The two channels (51) are parallel to each other. Two pawls (51) each is reciprocally received in a corresponding one of the two channels (51) and partially extending out of the pivot seat (50). An adjusting ring (60) is pivotally mounted around the pivot seat (50). The adjusting ring (60) has two grooves (61) longitudinally defined in an inner periphery of the adjusting ring (60) and a guiding portion (62) formed on the inner periphery of the adjusting ring (60) between the two grooves (61) of the adjusting ring (60). The two grooves (61) are provided to selectively receive a distal end of a corresponding one of the two pawls (51) to change the operated direction of the screwdriver.

However, the pivot seat (50) has no enough space to centrally define a through hole to receive a long tip because the pivot seat (50) has two channels (51) defined therein such that the conventional screwdriver is in a narrow-range.

With reference to FIG. 8, another ratchet screwdriver is shown. The ratchet screwdriver includes a handle (not numbered) and an operating device (80) mounted in and near a bottom of the handle. A barrel (70) is rotatably and centrally received in the handle. The operating device (80) is connected with the barrel (70) for selectively driving the barrel (70). A switch (90) is mounted in the operating device (80) and partially extending through the handle for user to change the operated direction of the operating device (80). The conventional screwdriver can be used with a long tip because the operating device is mounted near the bottom of the handle and the barrel (70) extends to the operating device (80).

However, to mount the operating device (80) near the bottom of the handle for using with a long tip is an inconvenient design. The user must move the screwdriver from one hand to another for adjusting the switch (90) to change the operated direction of the screwdriver.

The present invention has arisen to mitigate and/or obviate the disadvantages of the two conventional screwdrivers.

SUMMARY OF THE INVENTION

The main objective of the present invention is to provide an improved operating device for a screwdriver that can be used with a long tip.

To achieve the objective, the operating device in accordance with the present invention comprises a body including a through hole longitudinally and centrally defined in the body. The through hole has an enlarged portion formed in one end of the body. A first channel is defined in the body and corresponds to the enlarged portion of the through hole. The first channel communicates with the enlarged portion of the through hole. A second channel is defined in the body. The second channel corresponds to the first channel and the enlarged portion of the through hole. The second channel communicates with the enlarged portion of the through hole. A barrel is partially and pivotally received in the first through hole in the body. The barrel includes a polygonal hole therein and centrally extending through the barrel for receiving a long tip. A series of teeth is formed on an outer periphery of the barrel and corresponds to the enlarged portion of the through hole. A controller is pivotally mounted on the body for controlling an operate direction of the screwdriver. The controller includes a first pawl movably received in the first channel in the body and selectively engaged to the series of teeth of the barrel to control the operate direction of the screwdriver. The first pawl extends over the body and has a first guide side formed on a free end of the first pawl. A first resilient member is mounted in the first channel and abuts against the first pawl to push the first pawl toward the series of teeth of the barrel. A second pawl is movably received in the second channel in the body and is selectively engaged to the series of teeth of the barrel to control the operate direction of the screwdriver. The second pawl extends over the body and has a second guide side formed on a free end of the second pawl. A second resilient member is mounted in the second channel and abuts against the second pawl to push the second pawl toward the series of teeth of the barrel. A cover is pivotally mounted to the body for driving the first pawl and the second pawl to control the operate direction of the screwdriver. The cover has a clutch attached to the cover. The clutch has a first side corresponding to the first guide side of the first pawl and a second side corresponding to the second guide side of the second pawl.

Further benefits and advantages of the present invention will become apparent after a careful reading of the detailed description with appropriate reference to the accompanying drawings.

DETAILED DESCRIPTION OF THE INVENTION

Figure 1:
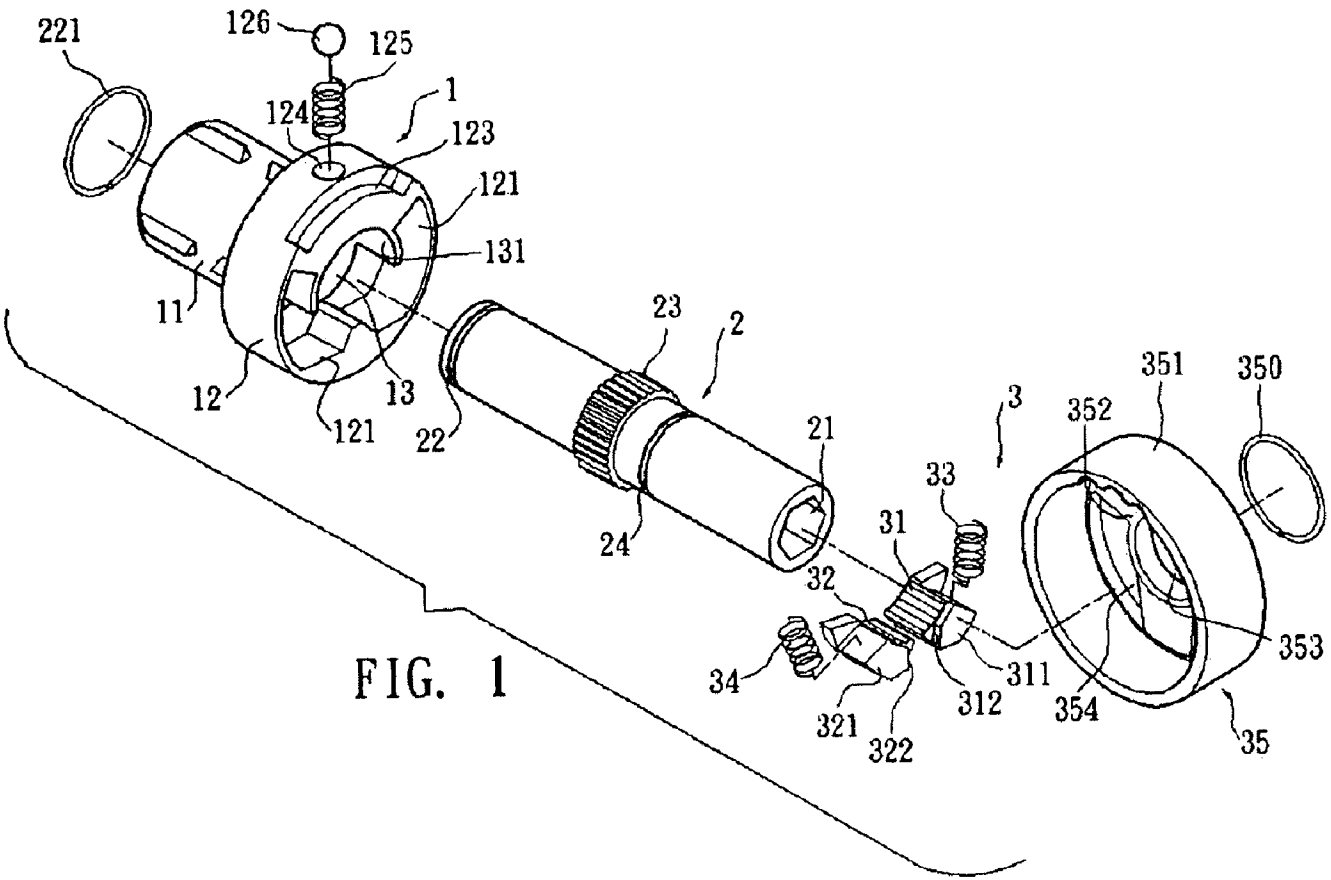
FIG. 1 is an exploded perspective view of a operating device for a screwdriver in accordance with the present invention.
Figure 2:
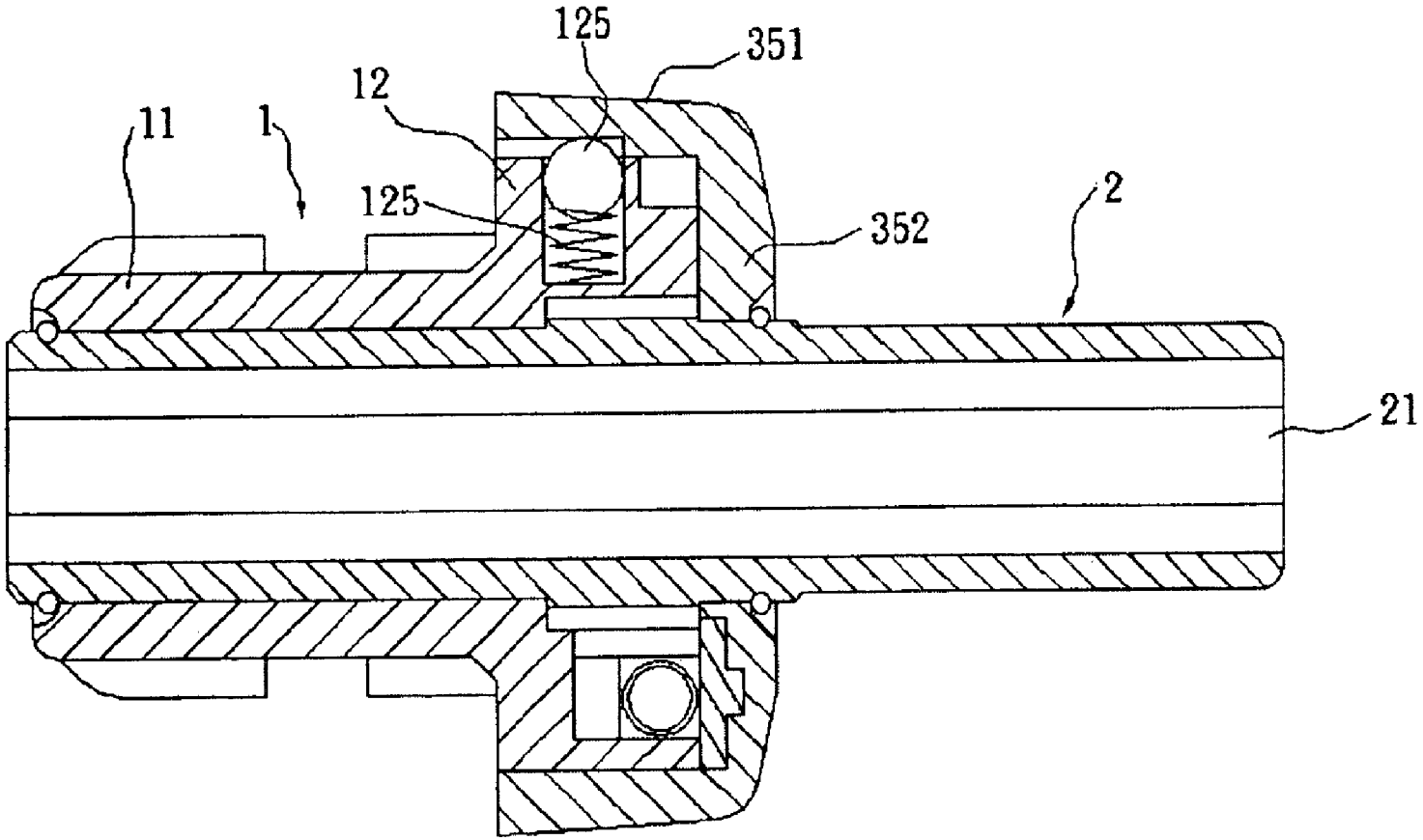
FIG. 2 is a cross sectional side plan view of the operating device for a screwdriver of the present invention.
Figure 3:
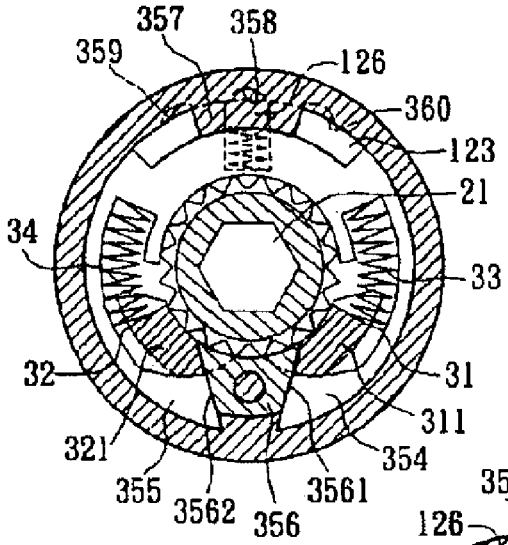
FIG. 3 is a first operational top plan view of the operating device in FIG. 2.

Referring to the drawings and initially to FIGS. 1–3, a operating device for a screwdriver in accordance with the present invention comprises a body (1) adapted to be partially secured in a handle (4) of the screwdriver, a barrel (2) partially and pivotally received in the body (1) and a controller (3) pivotally mounted on the body (1) for controlling an operated direction of the operating device.

The body (1) includes a first through hole (13) longitudinally and centrally defined in the body (1). The body (1) includes a column (11) adapted to be securely inserted into the handle of the screwdriver and a pivot seat (12) integrally formed with the column (11). The first through hole (13) has an enlarged portion (131) formed and corresponding to the pivot seat (12). The pivot seat (12) has a first channel (121) and a second channel (122) respectively defined in the pivot seat (12) and corresponding to each other. The first channel (121) and the second channel (122) correspond to and communicate with the enlarged portion (131) of the through hole (13). A cutout (123) is defined in an outer periphery the pivot seat (12) and extending to a top of the pivot seat (12) between the first channel (121) and the second channel (122). A blind hole (124) is radially defined in the outer periphery of the pivot seat (12) and a first spring (125) is compressively received in the blind hole (124). A steel ball (126) is partially received in the blind hole (124) to compress the first spring (125).

The barrel (2) includes a polygonal hole (21) longitudinally defined in the barrel and centrally extending through the barrel (2). The barrel (2) has a first end extending through the first through hole (13) in the body (1) and a first annular groove (22) defined near the first end of the barrel (2). A first C-shaped ring (221) mounted on the first annular groove (22) after the first end of the barrel (2) extending through the body (10) to hold the barrel in place. A series of teeth (23) is formed on an outer periphery of the barrel (2) and corresponds to the enlarged portion (131) of the through hole (13) in the body (1). The series of teeth (23) has a diameter slightly smaller than that of the enlarged portion (131) of the through hole (13) such that the series of teeth (23) is rotatably received in the enlarged portion (131) of the through hole (13) after the first end of the barrel (2) extending through the body (1). The barrel (2) includes a second end and a second annular groove (24) defined in the outer periphery of the barrel (2) between the second end of the barrel (2) and the series of teeth (23).

The controller (3) includes a first pawl (31) and a second pawl (32) respectively movably received in the first channel (121) and the second channel (122) in the pivot seat (12). The first pawl (31) and the second pawl (32) correspond to each other and are selectively engaged to the series of teeth (23) of the barrel (2) to control the operated direction of the barrel (2). The first pawl (31) has a first protrusion (311) longitudinally extending therefrom over the pivot seat (12). The first protrusion (311) has an inclined first guide side (312) formed thereon and facing the second pawl (32). The second pawl (32) has a second protrusion (321) extending therefrom over the pivot seat (12). The second protrusion (321) has an inclined second guide side (322) formed thereon and facing the first pawl (31). A second spring (33) is compressively mounted between the first pawl (31) and one side of the first channel (121), and a third spring (34) is compressively mounted between the second pawl (32) and one side of the second channel (122). The restitution force of the second spring (33) and the second spring (34) pushes the first pawl (31) and the second pawl (32) toward each other. A cover (35) is pivotally mounted around the pivot seat (12). The cover (35) includes a skirt (351) mounted around the outer periphery of the pivot seat (12) and a shoulder (352) radically extending from one end of the skirt (351) opposite to the body (1) and defining a second through hole (353) to allow the barrel (2) extending through the cover (35). A second C-shaped ring (350) is mounted one the second annular groove (24) to hold the cover (35) in place after the barrel (2) extending through the cover (35). The cover (35) has a first recess (354) defined in the shoulder (352) for receiving the first protrusion (311) of the first pawl (31) and a second recess (355) defined in the shoulder (352) for receiving the second protrusion (321) of the second pawl (32). A clutch (356) is securely attached to the shoulder (352) between the first recess (354) and the second recess (355) for driving the first pawl (31) and the second pawl (32) to selectively engage to the series of teeth (23). The width of the clutch (356) is gradually enlarged relative to the barrel (2). The clutch (356) has a first side (3561) corresponding to the first guide side (312) and a second side (3562) corresponding to the second guide side (322). The cover (35) includes a stopper (357) extending from the shoulder (352) and slidably received in the cutout (123) in the pivot seat (12) to limit the rotating range of the cover (35). A first indentation (358), a second indentation (359) and a third indentation (360) are defined in an inner periphery of the skirt (351) to partially receive the steel ball (126) for user to easily control the rotating range of the cover (35).

With reference to FIG. 3, the first side (3561) and the second side (3562) respectively abut the first guide side (312) and the second guide side (322), the first pawl (31) and the second pawl (32) are respectively engaged to the series of teeth (23) and the steel (126) is partially received in the first indentation (358). Consequently, the screwdriver is used as a conventional screwdriver without operating device.

Figure 4:
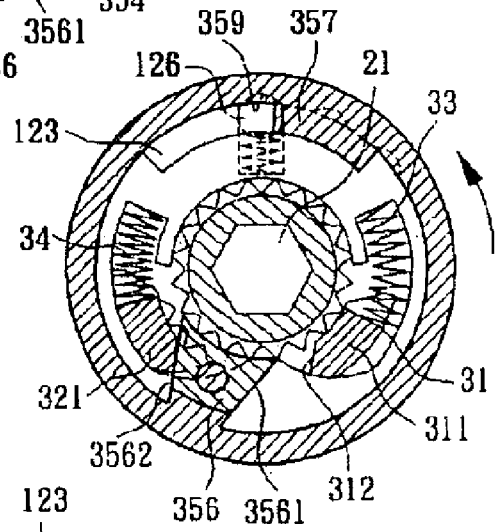
FIG. 4 is a second operational top plan view of the operating device in FIG. 2.

With reference to FIG. 4, the second pawl (32) is disengaged from the series of teeth (23) when the cover (35) is rotated toward the second pawl (32), the clutch (356) outwardly pushes the second pawl (32), the second guide side (322) is moved along the second side (3562) and the steel ball (126) is partially received in the second indentation (359). Consequently, the barrel (2) is only rotated along the arrow as shown in FIG. 4 and cannot be rotated back because the first pawl (31) abuts against the periphery of the first channel (121). The first pawl (32) is slightly pushed back relative to the skirt (351) and compresses the second spring (33) so that the first pawl always abuts the series of teeth (23) of the barrel (2) due to the restitution force of the second spring (33).

Figure 5:
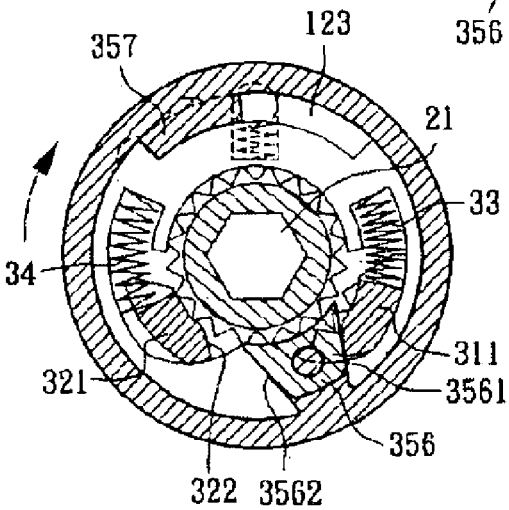
FIG. 5 is a third operational top plan view of the operating device in FIG. 2.

With reference to FIG. 5, the first pawl (31) is disengaged from the series of teeth (23) when the cover (35) is rotated toward the first pawl (31), the clutch (356) outwardly pushes the first pawl (31), the first guide side (312) is moved along the first side (3561) and the steel ball (126) is partially received in the third indentation (360). Consequently, the barrel (2) is only rotated along the arrow as shown in FIG. 5 and cannot be rotated back because the second pawl (31) abuts against the periphery of the second channel (122). The second pawl (31) is slightly pushed back relative to the skirt (351) and compresses the third spring (34) so that the second pawl (32) always abuts the series of teeth (23) of the barrel (2) due to the restitution force of the third spring (34).

Figure 6:
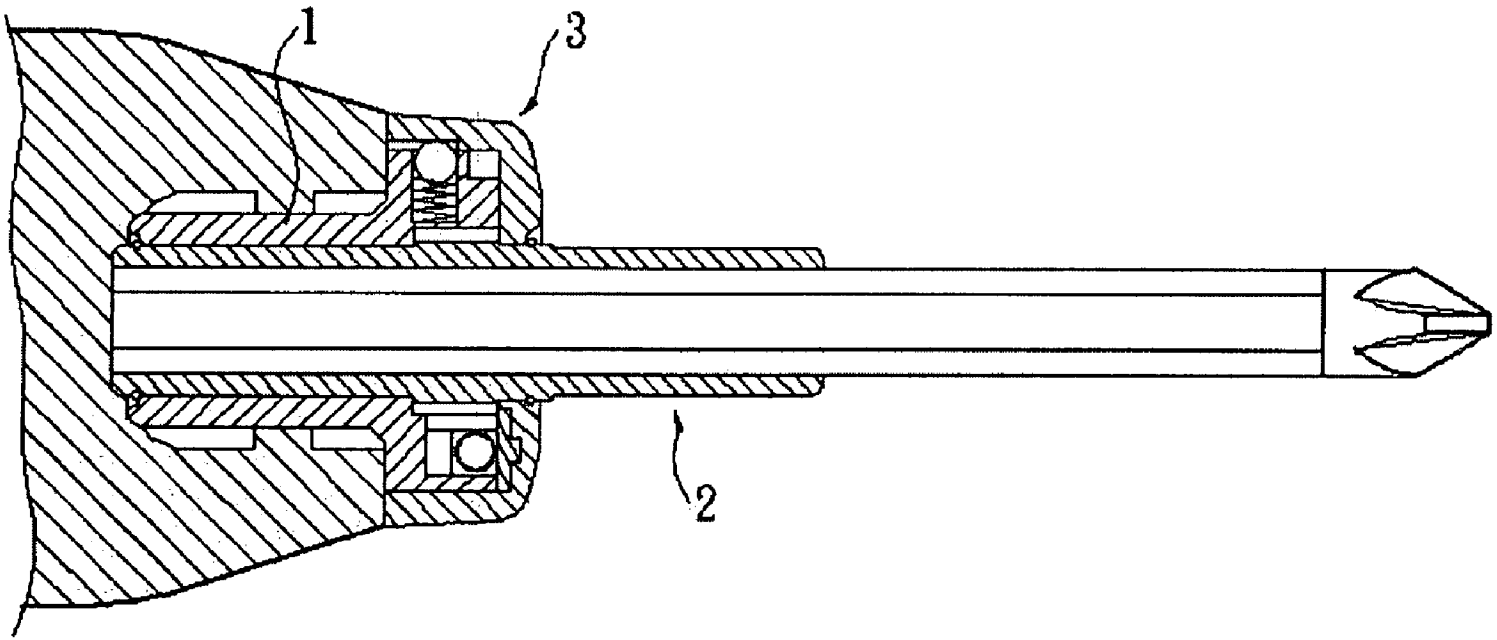
FIG. 6 is a schematic view of the operating device in FIG. 2 showing the operating device secured on a handle of the screwdriver.
Figure 7:
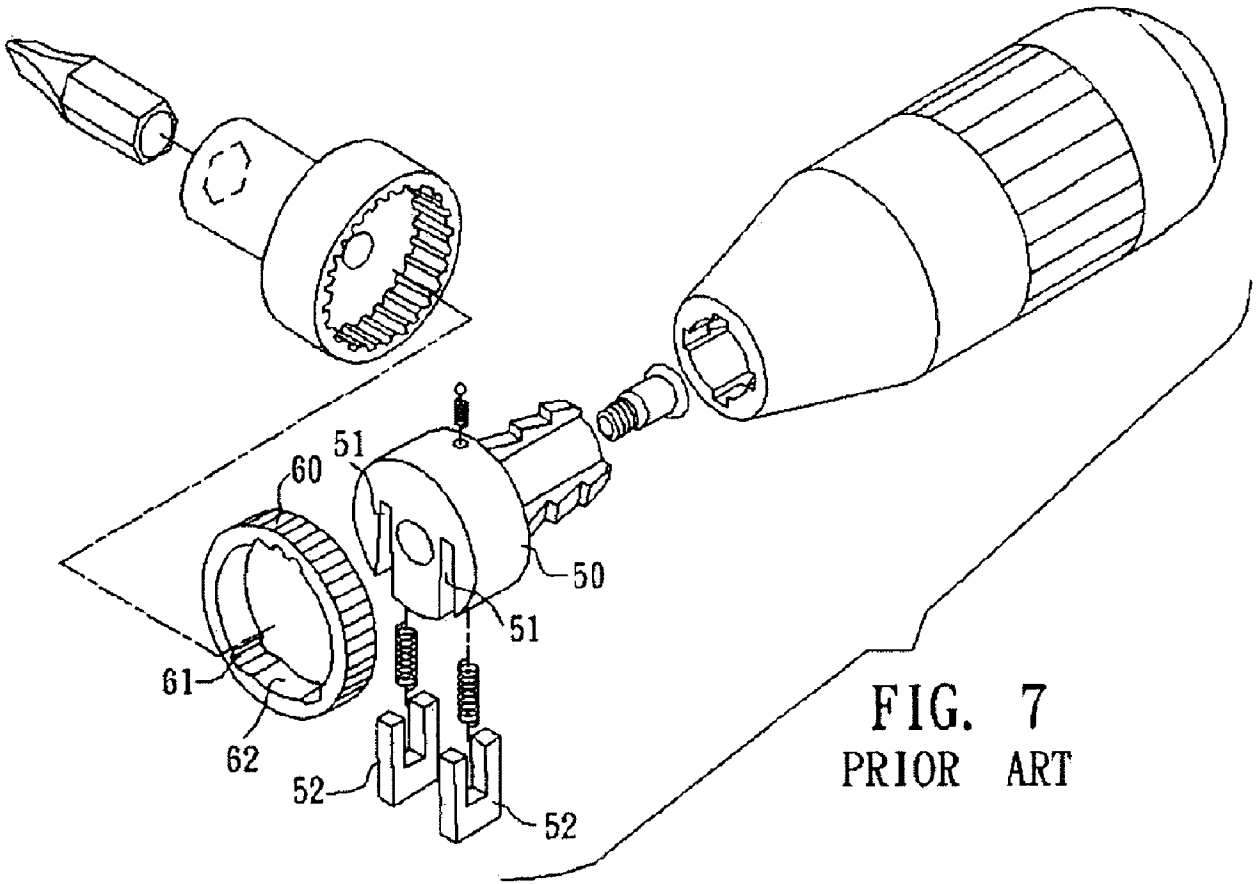
FIG. 7 PRIOR ART
FIG. 7 is an exploded perspective view of a operating device for a screwdriver in accordance with the prior art.
Figure 8:
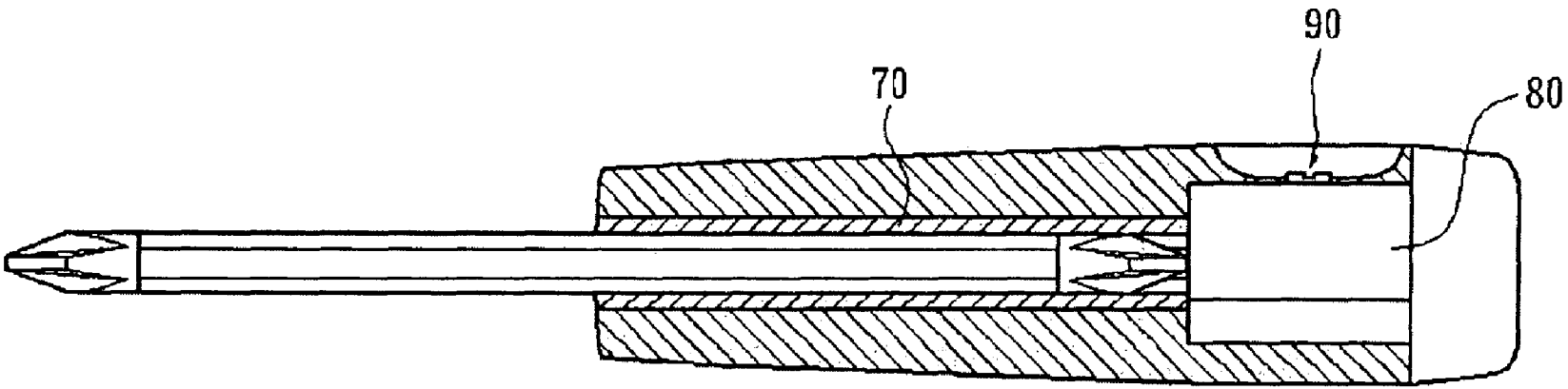
FIG. 8 PRIOR ART
FIG. 8 is a cross sectional side plan view of a ratchet screwdriver in accordance with the prior art.

With reference to FIGS. 1 and 6, the series of teeth (12) in accordance with the present invention is formed on the outer periphery of the barrel (2) so that the polygonal hole (21) is easily longitudinally defined in and extending through the barrel to receive a long tip and the switch for controlling the operating device is disposed near the top of the handle (4) of the screwdriver. Consequently, the operating device in accordance with the present invention is a convenient design for user to operate with a long tip and sassily change the operate direction of the screwdriver on which the operating device of the present invention is mounted.

Although the invention has been explained in relation to its preferred embodiment, it is to be understood that many other possible modifications and variations can be made without departing from the spirit and scope of the invention as hereinafter claimed.

What is claimed is:

1. An operating device for a screwdriver, comprising:

a body, the body having (a) a first through hole longitudinally and centrally formed therein, the first through hole having an enlarged open portion formed in one end of the body, (b) a first channel formed in the body in correspondence to the enlarged open portion of the first through hole and in open communication therewith, and (c) a second channel formed in the body in correspondence to the first channel and the enlarged open portion of the first through hole and in open communication therewith;

a longitudinally extended barrel rotatably and at least partially received in the first through hole of the body, the barrel having a polygonal hole formed longitudinally and centrally through the barrel, the polygonal hole being adapted to receive a screwdriver tip at least partially therein, the barrel having a plurality of teeth formed on an outer periphery thereof and located longitudinally on the barrel to be in correspondence with the enlarged open portion of the first through hole; and a controller mounted to the body for controlling an operational direction of the screwdriver, the controller including:

a first pawl movably received in the first channel of the body and selectively engageable with a portion of the plurality of teeth on the barrel to limit rotation of the barrel relative to the body in a first direction, the first pawl extending outwardly from the body and having a first guide side formed on a free end of the first pawl;

a first resilient member mounted in the first channel and abutting against the first pawl to push the first pawl toward the plurality of teeth on the barrel;

a second pawl moveable received in the second channel of the body and selectively engageable with a portion of the plurality of teeth on the barrel to limit rotation of the barrel relative to the body in a second direction, the second pawl extending outwardly from the body and having a second guide side formed on a free end of the second pawl;

second resilient member mounted in the second channel and abutting against the second pawl to push the second pawl toward the plurality of teeth of the barrel; and, a cover rotatably mounted to the body for driving the first pawl and the second pawl to control an operational direction of the screwdriver, the cover having a clutch coupled thereto, the clutch having a first side corresponding to the first guide side of the first pawl and a second side corresponding to the second guide side of the second pawl.

2. The operating device as claimed in claim 1, wherein the first pawl comprises a first protrusion extending therefrom over the body and the first guide side is formed on the first protrusion, and the second pawl comprises a second protrusion extending therefrom over the body and the second guide side is formed on the second protrusion.

3. The operating device as claimed in claim 2, wherein the body comprises a column adapted to be secured in a handle of the screwdriver and a pivot scat integrally formed with the column, the pivot seat having the enlarged open portion of the first through hole, the first channel and the second channel formed therein.

4. The operating device as claimed in claim 3, wherein the cover comprises:

a skirt mounted around an outer periphery of the pivot seat;

a shoulder radially extending from one end of the skirt opposite to the body and defining a second through hole to allow the barrel extending through the cover;

a first recess defined in the shoulder for receiving the first protrusion of the first pawl; and a second recess defined in the shoulder for receiving the second protrusion of the second pawl, the second recess corresponding to the first recess.

5. The operating device as claimed in claim 1, wherein the body comprises a column adapted to be secured in a handle of the screwdriver and a pivot scat integrally formed with the column, the pivot seat having the enlarged open portion of the first through hole, the first channel and the second channel formed therein.

6. The operating device as claimed in claim 5, wherein the cover comprises:

a skirt mounted around an outer periphery of the pivot seat;

a shoulder radially extending from one end of the skirt opposite to the body and defining a second through hole to allow the barrel extending through the cover;

a first recess defined in the shoulder for receiving the first protrusion of the first pawl; and a second recess defined in the shoulder for receiving the second protrusion of the second pawl, the second recess corresponding to the first recess.

7. An operating device for a screwdriver, comprising:

a body formed by a column adapted to be secured in a handle of the screwdriver and a pivot seat integrally formed with the column, the body including;

a first through hole longitudinally and centrally formed in the body, the first through hole having an enlarged open portion formed in the pivot seat;

a first channel formed in the pivot seat in correspondence to the enlarged portion of the first through hole, and in open communication therewith;

a second channel formed in the pivot seat in correspondence to the first channel and the enlarged portion of the first through hole and in open communication therewith; and a cutout formed in an outer a peripheral edge of the pivot seat;

a longitudinally extended barrel rotatably and at least partially received in the first through hole in the body, the barrel having a polygonal hole formed longitudinally and centrally through the barrel for receiving at least a portion of a long screwdriver tip therein, the barrel having plurality of teeth formed on an outer periphery thereof and located longitudinally on the barrel to be in correspondence with the enlarged portion of the first through hole; and, a controller rotatably mounted to the pivot seat of the body for controlling an operational direction of the screwdriver, the controller including:

a first pawl movably received in the first channel and selectively engageable with a portion of the plurality of teeth on the barrel to limit rotation of the barrel relative to the body in a first direction, the first pawl extending outwardly from the pivot seat and having a first guide side formed on a free end of the first pawl;

a first resilient member mounted in the first channel and abutting against the first pawl to push the first pawl toward the plurality of teeth on the barrel;

a second pawl movably received in the second channel and selectively engageable with a portion of the plurality of teeth of the barrel to limit rotation of the barrel relative to the body in a second direction, the first pawl extending outwardly from the pivot seat and having a second guide side formed on a free end of the second pawl;

a second resilient member mounted in the second channel and abutting against the second pawl to push the second pawl toward the plurality of teeth on the barrel; and a cover rotatably mounted to the body for driving the first pawl and the second pawl to control an operational direction of the screwdriver, the cover having a clutch attached thereto, the clutch having a first side corresponding to the first guide side of the first pawl and a second side corresponding to the second guide side of the second pawl, the cover having a stopper extending therefrom and disposed in the cutout of the pivot seat for limiting rotation of the cover relative to the body.

8. The operating device as claimed in claim 7, wherein the first pawl comprises a first protrusion extending therefrom over the pivot seat and the first guide side is formed on the first protrusion, and the second pawl comprises a second protrusion extending therefrom over the pivot seat and the second guide side is formed on the second protrusion.

9. The operating device as claimed in claim 7, wherein the cover comprises:

a skirt mounted around an outer periphery of the pivot seat;

a shoulder radially extending form one end of the skirt opposite to the body and defining a second through hole to allow the barrel extending through the cover;

a first recess defined in the shoulder for receiving the first protrusion of the first pawl; and a second recess defined in the shoulder for receiving the second protrusion of the second pawl, the second recess corresponding to the first recess.

* * * * *